US006817366B1

(12) United States Patent
Weiss

(10) Patent No.: US 6,817,366 B1
(45) Date of Patent: Nov. 16, 2004

(54) BEVERAGE FLOW LINE CLEANER WITH SAFETY INDICATOR AND METHOD OF USE

(75) Inventor: Leonard Weiss, Mt. Olive, IL (US)

(73) Assignee: L W Chemicals, Inc., Mt. Olive, IL (US)

( * ) Notice: Subject to any disclaimer, the term of this patent is extended or adjusted under 35 U.S.C. 154(b) by 246 days.

(21) Appl. No.: 10/279,422

(22) Filed: Oct. 24, 2002

(51) Int. Cl.[7] ..... B08B 9/027

(52) U.S. Cl. ..... 134/22.13; 134/22.17; 134/26; 137/15.05

(58) Field of Search ..... 134/22.1, 22.13, 134/22.16–22.17, 25.3, 26, 94.1, 95.1, 100.1, 169 C, 166 C; 137/15.01, 15.05, 240; 141/91; 222/148

(56) References Cited

U.S. PATENT DOCUMENTS

| | | | | | |
|---|---|---|---|---|---|
| 2,098,525 | A | * | 11/1937 | Smith | 134/93 |
| 2,196,176 | A | * | 4/1940 | Brigham | 137/15.05 |
| 3,580,261 | A | | 5/1971 | Key | |
| 3,830,248 | A | * | 8/1974 | Brown | 134/100.1 |
| 3,959,166 | A | | 5/1976 | Oberhofer et al. | |
| 4,105,576 | A | | 8/1978 | Seidenberger | |
| 4,348,292 | A | | 9/1982 | Ginn | |
| 4,436,227 | A | | 3/1984 | Johnson, Jr. et al. | |
| 4,941,593 | A | * | 7/1990 | Hicks et al. | 222/148 |
| 5,072,859 | A | | 12/1991 | Wiley et al. | |
| 5,090,440 | A | | 2/1992 | Ladouceur et al. | |
| 5,277,819 | A | * | 1/1994 | Abrams | 210/636 |
| 5,336,334 | A | | 8/1994 | Johnson | |
| 5,534,167 | A | | 7/1996 | Billman | |
| 5,538,664 | A | | 7/1996 | Michael | |
| 5,601,101 | A | * | 2/1997 | Grapes et al. | 134/56 R |
| 5,601,127 | A | | 2/1997 | Hanson | |
| 5,858,114 | A | | 1/1999 | Board et al. | |
| 6,080,244 | A | * | 6/2000 | Wiatr et al. | 134/26 |
| 6,093,687 | A | | 7/2000 | Saito et al. | |
| 6,564,813 | B1 | * | 5/2003 | Lengling et al. | 134/22.1 |

OTHER PUBLICATIONS

Material Safety Data Sheet *Product Identification* Manufacturer Name: LW Chemicals, Inc.; Date: Jan. 15, 2002.

Material Safety Data Sheet Pylam Blue LX–10199 LX 10199; Dec. 6, 2001.

OxyChem Responsible Care A Public Commitment Material Safety Data Sheet; Oct. 19, 1998; 16 pages.

Budweiser The Beertender Guide (Brochure) College of Sales & Marketing.

* cited by examiner

*Primary Examiner*—Frankie L. Stinson
*Assistant Examiner*—Joseph Perrin
(74) *Attorney, Agent, or Firm*—Polster, Lieder, Woodruff & Lucchesi, L.C.

(57) ABSTRACT

A method of cleaning potable liquid flow lines employing a high pH caustic cleaning solution or a low pH acid cleaning solution with a stable dye in sufficient concentration so as to have a visible color when the solution is further diluted. The cleaning solution is pumped through the lines. The lines then are flushed with clean water until no colored solution is discharged from the lines, indicating the lines have been purged of cleaning solution. The method can be used with draft beer, soft drink or other potable liquid flow lines to prevent inadvertent consumption of caustic cleaning solution along with subsequently dispensed potable liquid.

6 Claims, No Drawings

BEVERAGE FLOW LINE CLEANER WITH SAFETY INDICATOR AND METHOD OF USE

REFERENCE TO RELATED APPLICATIONS

None

STATEMENT REGARDING FEDERALLY SPONSORED RESEARCH OR DEVELOPMENT

Not applicable

BACKGROUND OF THE INVENTION

The invention relates generally to a method of cleaning the flow lines of a dispensing system for potable liquid products and, more particularly, a method and product that provides for complete removal of residual harsh caustic or acidic cleaning material from the lines after cleaning thereby preventing inadvertent consumption of the harsh or potentially toxic material along with subsequently dispensed potable liquid.

Many restaurants, bars, taverns, entertainment venues and the like provide refreshments including beverages such as draft beer or soft drinks for purchase and consumption by their customers. Often these beverages are supplied to the business in bulk and dispensed through an appropriate beverage dispensing system into a cup or glass for consumption by the customer. Draft beer, for example, is proved by the brewery in a bulk container, such as a beer barrel or keg. Normally a line, such as a PVC line, runs from the pressurized barrel to the tap or faucet. The server opens the tap and the beer under pressure flows out into a cup or other container. Likewise, soft drinks are provided in canisters and served through a gas-pressurized system.

To maintain the freshness and purity of the dispensed beverages, the lines require periodic cleaning. For example, draft beer lines are cleaned on a regular basis. Despite the type of draft beer line cleaning equipment that is used, the cleaning process includes two general steps: 1). injection and circulation of cleaning solution through the draft lines to remove organic soils, protein, deposits and bacteria and 2). rinsing of the lines, usually with plain water, to ensure that all cleaning solution has been flushed from the lines.

The chemicals used to clean and disinfect the lines are manufactured in concentrated form and diluted, usually one (1) to three (3) ounces of cleaner to gallon of water. The cleaning chemicals used to clean beverage flow lines generally are harsh, being caustic, having a relatively high pH. In other applications, harsh acidic cleaning solutions may be used. In any event, it is imperative that all cleaning solution be flushed and purged from the lines before the lines are reconnected and consumable product flows through the lines. If there is residual harsh or caustic cleaning solution left in the lines, it can be dispensed along with the next beverage and inadvertently be consumed, causing a health and safety risk. Because the cleaning solutions essentially are clear, heretofore no really good method of determining that the cleaning solution has been purged from the lines has been available.

SUMMARY OF THE INVENTION

It is among the various aspects and objects of the invention to provide a method for ensuring that harsh, caustic, acidic or potentially toxic cleaning materials are removed from a beverage dispensing system after cleaning to prevent inadvertent consumption of the material by a consumer.

It is also is among the various aspects and objects of the present invention to provide a method of determining when cleaning solution has been completely purged from the flow lines for potable fluids, such as beer or soft drink. Also, the present invention provides for the detection of spills of the caustic cleaning solution before the solution can cause harm or damage.

Another aspect of the invention is a potable liquid flow line cleaning solution that includes a stable color indicator so that the user can visually determine when all the colored cleaning solution has been flushed from the lines. The cleaning solution is provided as a concentrated cleaning solution including a color indicator that maintains a readily visualized color upon dilution of the concentrated cleaning solution in water. The color indicator does not separate from the cleaning solution while stored even in high pH environment. The invention provides a concentrated cleaning solution including a color indicator that maintains the coloring agent in concentration even in low pH environment.

In accordance with one preferred aspect of the invention, a method is provided of assuring the removal of any residual harsh caustic, acidic or hazardous cleaning solution from beverage dispensing flow lines after cleaning so as to prevent inadvertent consumption of the cleaning solution along with a subsequently dispensed beverage. The invention provides for cleaning potable liquid flow lines, for example draft beer lines, with a high pH, caustic cleaning solution that includes a compatible color indicator in solution. The cleaning solution with the color indicator is provided in a concentrated form. The cleaning solution is diluted in an appropriate amount of water to yield an effective cleaning solution having a color indicator that can easily be visualized when flowing through the beverage lines. The cleaning solution then is purged or rinsed from the lines with clear liquid, for example water, until the discharged rinse water is free of color, thereby indicating that any residual cleaning material has been removed from the lines. A further safety feature of the present invention is that if any of the colored cleaning solution is inadvertently introduced into the beverage, for example, inadvertently introduced into the beer keg, the subsequently dispensed beverage would be tinted, indicating that it should be discarded and the lines reflushed.

The cleaning solution having a color indicator allows for easy visualization of any spills or splashes of the solution so that it can be removed from the user's skin or other surfaces before the caustic cleaning solution causes any harm or damage.

The invention provides a high pH cleaning solution in which the color indicator does not separate from the cleaning solution, either in the concentrated form or the diluted form. One embodiment of the invention provides concentrated cleaning solution comprising caustic potash as the active ingredient. The concentrated solution has a pH of approximately 10 to 15, for example 13. The concentrated cleaning solution also includes an indicator comprising a dye, for example a blue dye that remains in solution in the concentrated cleaning solution. The optimum concentration of the dye in the concentrated cleaning solution ranges from about 0.04% w/v to about 0.10% w/v, preferably about 0.07% w/v. The concentrated cleaning solution with the indicator dye is diluted in water in a ratio of approximately two (2) ounces of cleaning solution per gallon of water. The cleaning solution then is used to clean the lines. The lines are flushed with clean water until no blue residue is visualized, indicating that the caustic cleaning solution is completely purged from the lines.

In another aspect of the invention, the cleaning solution is acidic, having a pH in the range of approximately 2 to 3. Dye, for example the blue dye, in the appropriate amount, is added to the acidic cleaning solution and employed to clean the flow lines. The lines are flushed with clean water until no blue residue is visualized, indicating that the acidic cleaning solution is completely purged from the lines. The methods and products of the present invention can be employed to clean any potable liquid flow lines, such as beer, soft drinks, water and so forth.

DETAILED DESCRIPTION OF THE INVENTION

The following detailed description of the invention provides the best mode of making and working the invention presently known by the inventor.

The method of the present invention, in general, comprises a method of preventing the inadvertent consumption of a harsh, potentially toxic cleaning solution by cleaning potable liquid flow lines with a cleaning solution having a color indicator in a preferred concentration that remains in solution and then flushing the flow lines until the rinse solution is devoid of any color indicator, indicating that the cleaning solution has been purged from the lines to ensure that there is no residual cleaning solution in the lines that could be dispensed and consumed along with a subsequently dispensed beverage. The present invention also encompasses the method of cleaning the fluid flow lines.

The method and products of the present invention also are useful for determining if the beverage source has been contaminated during the cleaning process. Also, the products of the present invention allow, the detection of solution spills before the caustic material can cause harm or damage to skin or other surfaces. The products also can be used to clean apparatus other than beverage fluid flow lines to ensure complete removal of the cleaning solution to avoid contamination by the cleaning solution.

In the described embodiment the method is used in draft beer dispensing systems for purposes of simplicity and clarity. However, it is understood that the method and products of the instant invention are intended to be used to promote health and safety when used with any potable liquid or beverage dispensing system or when cleaning any apparatus or material with highly caustic cleaning solutions.

In general, the basic line cleaning solution comprises a concentrated cleaning solution and a compatible colorant. The concentrated cleaning solution with compatible colorant generally is further diluted for use in line cleaning. In the preferred embodiment the concentrated cleaning solution has a high pH. More preferably the concentrated cleaning solution comprises potassium hydroxide (caustic potash) and a compatible colorant in water. Generally, the concentrated cleaning solution comprises approximately 15% to approximately 30% caustic potash. In one embodiment, the concentrated solution contains about 18% to less than 30% caustic potash (potassium hydroxide) and, in another, about 25% caustic potash. Other additives may include wetting agents, phosphate water conditioners or other additives known to the art. The concentrated solution is a clear corrosive liquid with no distinct odor. The pH of the concentrated cleaning solution is approximately 10 to approximately 15, for example around 13 in one embodiment. Caustic potash liquid is commercially available in bulk in varying concentrations of approximately 20% to approximately 50%. One commercial provider is Occidental Chemical Corp., Dallas. Texas. The bulk caustic potash can be diluted with water to the preferred concentrations. When added to water the caustic potash generates heat and appropriate precautions are used.

An indicator colorant or dye is added to the cleaning solution of the preferred concentration. The dye must be one that is physically and chemically compatible in a cleaning solution having a relatively high pH and that will not deteriorate or separate out of the concentrated cleaning solution after being dissolved in the cleaning solution. In the preferred embodiment, the dye is selected from the monoazo chemical family. The dye is provided in a soluble powder and has no odor. The dye is added to the concentrated cleaning solution in any amount that is determined to provide sufficient color in a further diluted solution to be effective as a safety indicator in the methods of the present invention as described in detail below. For example, less than 2 oz. (dry weight) to more than 10 oz (dry weight) of dye may be added to fifty-five (55) gallons of concentrated cleaning solution.

In one embodiment about three (3) oz. (dry weight) to about seven (7) oz. (dry weight) of the powdered dye is added to approximately fifty-five (55) gallons of the concentrated cleaning solution. Consequently, that embodiment has a concentration of dye of approximately 0.04% w/v to approximately 0.10% w/v or approximately 400 ppm to approximately 1000 ppm. In another, about five (5) oz. (dry weight) of dye in about fifty-five (55) gallons of concentrated cleaning solution is used. Consequently the more that concentration of dye is approximately 0.07% w/v or 700 ppm.

One type of dye determined by the inventor to be stable and compatible in high pH solutions is from the monoazo chemical family. One such commercially available monoazo dye is Pylam Blue LX-10199 blue dye, available Pylam Products Company, Inc., Tempe, Arizona. Although it is difficult to prepare stable solutions at high pH ranges, the inventor has determined that the concentrations described result in relatively stable colored concentrated cleaning solutions. For example, in concentrations exceeding 5 oz. of dye per 55 gallons of cleaning solution (i.e. greater than approximately 0.07% w/v), the dye stays in solution for an appropriate amount of time to allow use within a few days, and may be suitable for certain applications wherein a darker solution that will be used in a relatively short time period after preparation is desired. However, the inventor has determined that at a concentration of about 5 oz grams per 55 gallons of high pH concentrated cleaning solution, the color concentration is appropriate for most applications, even when further diluted, and the dye does not precipitate or separate and stays in solution for extended periods of time, at least three months and at typical transportation and storage temperatures.

In another embodiment, the dye is added to concentrated acidic cleaning solutions known to the art, having a low pH in the range of approximately 2 to 3. Because the dye generally remains more readily dissolved in acidic solutions, it can be employed in concentrations within the recited ranges or in even more concentrated forms, for example, exceeding 10 oz. (dry weight) in 55 gallons of acid cleaning solution, if desired for the intended application.

It will be appreciated that while the described embodiments provide for the use of a blue monoazo dye, any dye of any color from any chemical family or class that is compatible with the solutions and remains stable and dispersed in solution in the high pH (or low pH) environment at typical storage and transportation temperatures, and remains easily visualized after appropriate dilution, is intended to fall within the scope of the appended claims.

The described cleaning solution containing an appropriate concentration of colorant is employed in the methods of the present invention for cleaning beverage flow lines and for ensuring that all residual harsh, caustic or potentially harmful cleaning solution is removed or purged from the lines so as to prevent inadvertent consumption of the cleaning solution along with subsequently dispensed beverage. In general, the concentrated dyed cleaning solution is further diluted in water and then forced and circulated through the beverage dispensing system flow lines to remove organic soils, protein, deposits, contaminants, debris, bacteria and so forth. The lines then are purged with clear liquid, for example, clean rinse water, until the discharged rinse water is devoid of color, indicating that all residual colored cleaning solution has been purged from the lines.

By way of example only, a typical draft beer line cleaning procedures is set out as follows:

1. Shut off pressure supply at the cylinder.
2. Remove the tap from the barrel. Disconnect the tap from the beer line. Place the tap and beer line in a bucket on the floor.
3. Disconnect the faucet and place it in the bucket.
4. Open the cleaning canister head and fill the canister with warm water. Mix the above described concentrated cleaning solution containing the colorant to specification. Generally, one ounce of the concentrated cleaning solution is added to one gallon of warm water and approximately two ounces of concentrated cleaning solution per gallon of cold water.
5. Connect cleaner feed hose to beer shank.
6. Force the diluted cleaning solution through the lines in the opposite direct of the beer flow. Circulate the cleaning solution through the lines for approximately five (5) minutes.
7. Discharge the cleaning solution into the bucket.
8. After forcing all the diluted cleaning solution through the line and into the bucket, discard the solution from the bucket.
9. Rinse out the cleaning canister until the rinse water is free of any colored cleaning solution to make sure the canister cleans. Fill the canister with clean cool water and pump the clean water through the lines in the opposite direction of the beer flow and into the bucket.
10. Continue to rinse the lines until all colored cleaning solution is removed and the rinse water is clear and free from color, indicating that all the cleaning solution is purged from the lines.
11. Reassemble the beer lines, tap and faucet for use.

The above is a general outline of the cleaning procedures. In any event, whatever procedure is followed it is important that all cleaning solution be purged from the lines. By using the novel method and cleaning solution with the color indicator, it can be visually ascertained when the lines are purged of the cleaning solution. That is, when the rinse water is free of color, the user can be reasonably assured that the cleaning solution has been flushed out of the lines. By purging the lines of colored cleaning solution no residual caustic or hazardous cleaning solution remains in the lines to be dispensed along with beverage dispensed after the lines are cleaned. The procedure provides that residual cleaning solution will not be consumed along with subsequently dispensed beverage, providing a significant and novel safety improvement in beverage line cleaning.

In some instances, if the flow lines are not appropriately flushed or disconnected from the bulk beverage, cleaning solution can flow into the beverage source. For example, cleaning solution can be inadvertently introduced into a keg of beer. Heretofore, such contamination would go undetected and the contaminated beverage dispensed and consumed. With the products and method of the present invention, if cleaning solution is inadvertently introduced into the beverage, the subsequently dispensed beverage will be discolored and the contamination detected. This provides a significant improvement in safety.

Also, other apparatus may be cleaned by caustic potash solutions, such as the exteriors of bulk containers, barrels, taps, faucets or other metal or plastic objects or glass. The apparatus can be swabbed or washed with the colored caustic cleaner of the present invention, appropriately diluted, and then rinsed or wiped clean until no colored residue remains, assuring that the caustic or corrosive material is completely removed from the surface of the object.

Further, it will be appreciated that known caustic potash cleaning solutions are generally colorless and odorless. Therefore, if caustic potash cleaning solution is spilled or splashed, it may not be detected until it begins to cause harm. If the solution is spilled or splashed on skin it may not be detected until it burns or damages the tissue. However, with the novel cleaning solution of the present invention, an individual can readily see that the caustic material is on the skin by the presence of the colorant and can take measures, such as washing or flushing, to remove the material before it causes harm or damage.

This is a significant improvement in safety of using such materials.

What is claimed is:

1. A method of preventing inadvertent consumption by a consumer of a caustic material used for cleaning the flow lines of a beverage dispensing system, comprising:

diluting a concentrated caustic cleaning solution, said caustic cleaning solution comprising approximately 15% to approximately 30% potassium hydroxide and approximately 0.04% w/v to approximately 0.10% w/v monoazo dye;

introducing the diluted caustic cleaning solution into the flow lines of the beverage dispensing system to clean the flow lines;

circulating the diluted dyed caustic cleaning solution through the flow lines;

discharging the diluted dyed caustic cleaning solution;

introducing a substantially colorless flushing liquid into the flow lines to flush the flow lines and remove any residual dyed caustic cleaning solution from the flow lines along with discharged flushing liquid; and continuing to flush the system with the flushing liquid until the discharged flushing liquid is devoid of any dyed caustic cleaning solution, indicating that no residual dyed caustic cleaning solution remains in the lines to subsequently be dispensed with a potable liquid and inadvertently consumed by a consumer along with the subsequently dispensed potable liquid.

2. The method of claim 1 wherein the concentrated caustic cleaning solution has a pH from approximately 10 to approximately 15.

3. The method of claim 1 wherein the monoazo dye is a blue monoazo dye.

4. The method of claim 1 wherein the concentrated caustic cleaning solution comprises approximately 18% to less than 30% potassium hydroxide.

5. The method of claim 1 wherein the concentrated caustic cleaning solution comprises approximately 25% potassium hydroxide.

6. The method of claim 1 wherein the concentrated caustic cleaning solution comprises approximately 0.07% w/v monoazo dye.

* * * * *